US010947650B2

(12) United States Patent
Wu

(10) Patent No.: US 10,947,650 B2
(45) Date of Patent: Mar. 16, 2021

(54) WOVEN TEXTILE

(71) Applicant: JING HUNG LIANG LTD., Changhua County (TW)

(72) Inventor: Tsung-Jung Wu, Taichung (TW)

(73) Assignee: Jing Hung Liang Ltd., Changhua County (TW)

( * ) Notice: Subject to any disclaimer, the term of this patent is extended or adjusted under 35 U.S.C. 154(b) by 249 days.

(21) Appl. No.: 16/201,166

(22) Filed: Nov. 27, 2018

(65) Prior Publication Data

US 2019/0090587 A1 Mar. 28, 2019

Related U.S. Application Data

(63) Continuation-in-part of application No. 15/644,336, filed on Jul. 7, 2017, now Pat. No. 10,231,516.

(51) Int. Cl.

| | |
|---|---|
| ***D04B 21/06*** | (2006.01) |
| ***A43C 1/04*** | (2006.01) |
| ***A43B 23/02*** | (2006.01) |
| ***D04B 1/24*** | (2006.01) |
| ***D04B 21/20*** | (2006.01) |
| ***D04B 1/10*** | (2006.01) |
| *A43C 5/00* | (2006.01) |

(52) U.S. Cl.

CPC ..... *D04B 21/06* (2013.01); *A43B 23/025* (2013.01); *A43C 1/04* (2013.01); *D04B 1/102* (2013.01); *D04B 1/106* (2013.01); *D04B 1/24* (2013.01); *D04B 21/207* (2013.01); *A43C 5/00* (2013.01); *D10B 2501/043* (2013.01)

(58) Field of Classification Search

CPC ..... D04B 39/04; D04B 39/06; D04B 21/10; D04B 21/06; D03D 3/02; D03D 3/00; D03D 11/02; D03D 3/06; D03D 13/008; D03D 15/0033; D03D 15/0094; D03D 15/08

See application file for complete search history.

(56) References Cited

U.S. PATENT DOCUMENTS

| | | | | |
|---|---|---|---|---|
| 3,001,579 A | | 9/1961 | Van Doren | |
| 3,497,971 A | | 3/1970 | Hayashi | |
| 4,009,597 A | * | 3/1977 | Wall | D04B 21/18 66/193 |
| 4,818,316 A | * | 4/1989 | Weinle | D04B 21/18 156/148 |
| 5,125,246 A | * | 6/1992 | Shytles | D04B 21/04 66/191 |

(Continued)

FOREIGN PATENT DOCUMENTS

| | | |
|---|---|---|
| TW | M546126 U | 8/2017 |
| TW | I632875 B | 8/2018 |

*Primary Examiner* — Danny Worrell

(74) *Attorney, Agent, or Firm* — Muncy, Geissler, Olds & Lowe, P.C.

(57) ABSTRACT

A woven textile includes a woven body and an engaging portion. The woven body is woven by at least one thread and having a plurality through holes. The engaging portion comprises at least one filament. The at least one filament is woven with the at least one thread and extends with the at least one thread. The at least one filament extends away from the woven body for a distance and extends reversely back to the woven body to form a loop outside at least one fringe of the woven body. The at least one filament forms a plurality of the loops at intervals.

6 Claims, 3 Drawing Sheets

(56) References Cited

U.S. PATENT DOCUMENTS

| | | | | | |
|---|---|---|---|---|---|
| 5,265,445 | A | * | 11/1993 | Shytles | D04B 21/10 602/76 |
| 5,522,240 | A | * | 6/1996 | Wall | D04B 21/18 66/170 |
| 5,553,642 | A | * | 9/1996 | Tillon | D04B 39/06 139/11 |
| 5,662,147 | A | | 9/1997 | Haiber | |
| 5,802,883 | A | * | 9/1998 | Matsuda | A44B 19/343 66/193 |
| 6,330,892 | B1 | * | 12/2001 | Shimono | A44B 19/346 139/384 B |
| 7,287,553 | B2 | | 10/2007 | Wahhoud | |
| 9,924,761 | B2 | | 3/2018 | Huffa et al. | |
| 2004/0185734 | A1 | | 9/2004 | Gray et al. | |
| 2006/0059715 | A1 | | 3/2006 | Aveni | |
| 2011/0041359 | A1 | | 2/2011 | Dojan et al. | |
| 2012/0291908 | A1 | | 11/2012 | Lama | |
| 2017/0145608 | A1 | | 5/2017 | Ko | |

* cited by examiner

WOVEN TEXTILE

BACKGROUND OF THE INVENTION

Field of the Invention

The present invention is a CIP of application Ser. No. 15/644,336, filed Jul. 7, 2017, the entire contents of which are hereby incorporated by reference.

Description of the Prior Art

Recently, shoe body formed by woven textile becomes popular because of its better flexibility, fitting, permeability, and appearance. Shoe body having woven textile surface can be seen in sneakers of major brands.

Because the woven textile is mesh-like to have plural through holes, the shoelace is usually inserted through the through holes directly. To enhance the structure at the position where the shoelace is inserted, special pattern of weaving is used to form larger shoelace holes, as shown in patent TW 1632875. However, the woven textile is extremely difficult to design and weave. Different shoes need different designs. In addition, when the shoelace is pulled, part of the woven textile is also pulled so that the woven textile deforms irresversibly.

Patent TW M546126 shows another structure. Eyelet pieces are fixed on the fringe of the woven textile by melting or adhering. Though the woven textile is prevented from deformation, the process of manufacture is complicated. In addition, the eyelet pieces may fall off after using. Besides, the woven textile is disfeatured.

SUMMARY OF THE INVENTION

The main object of the present invention is to provide a woven textile having loops at fringe thereof for other objects to hook onto. In addition, the woven textile is easy to manufacture and is prevented from easy deformation.

To achieve the above and other objects, the woven textile of the present invention includes a woven body and an engaging portion. The woven body is woven by at least one thread and has a plurality through holes. The engaging portion comprises at least one filament. The at least one filament is woven with the at least one thread and extends with the at least one thread. The at least one filament extends away from the woven body for a distance and extends reversely back to the woven body to form a loop outside at least one fringe of the woven body. The filament forms a plurality of the loops at intervals.

Thereby, the woven textile has a plurality of loops at the fringe for other objects to hook onto. Even if the loops are pulled outward, the woven body may not deform.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
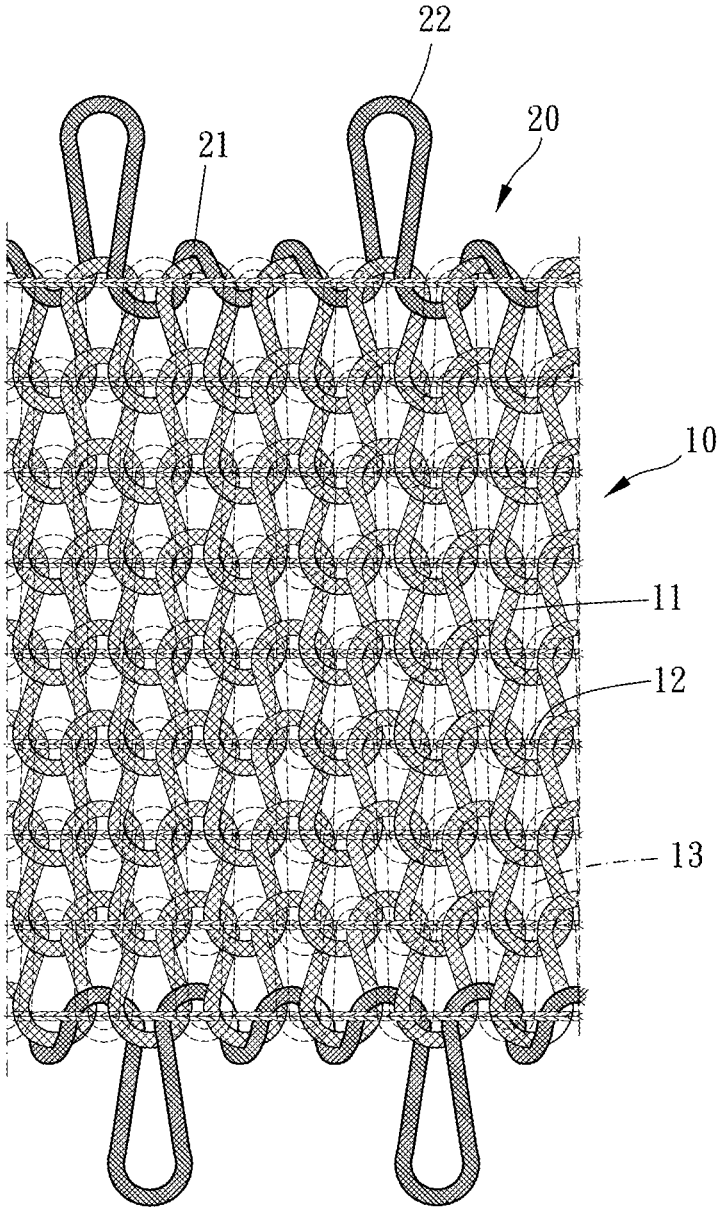
FIG. 1 is a front view of the present invention.
Figure 2:
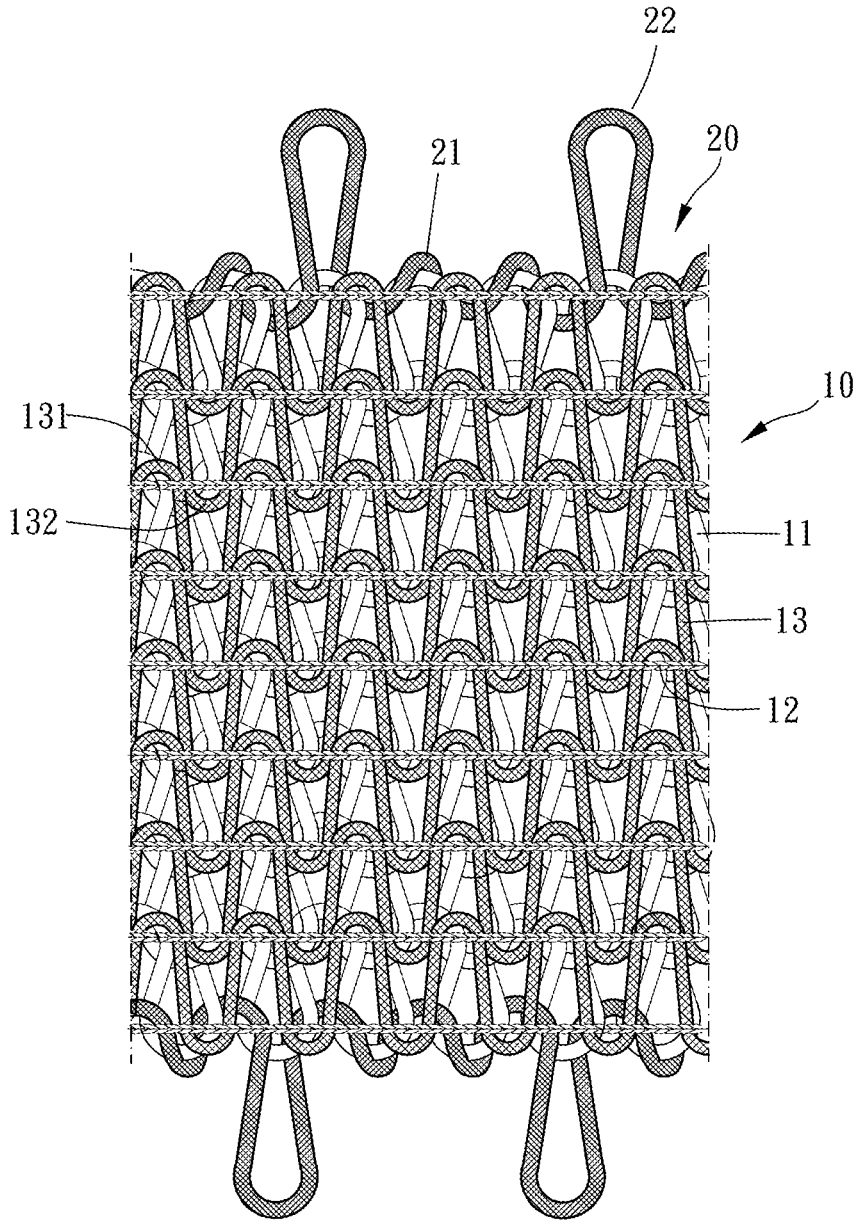
FIG. 2 is a rear view of the present invention.
Figure 3:
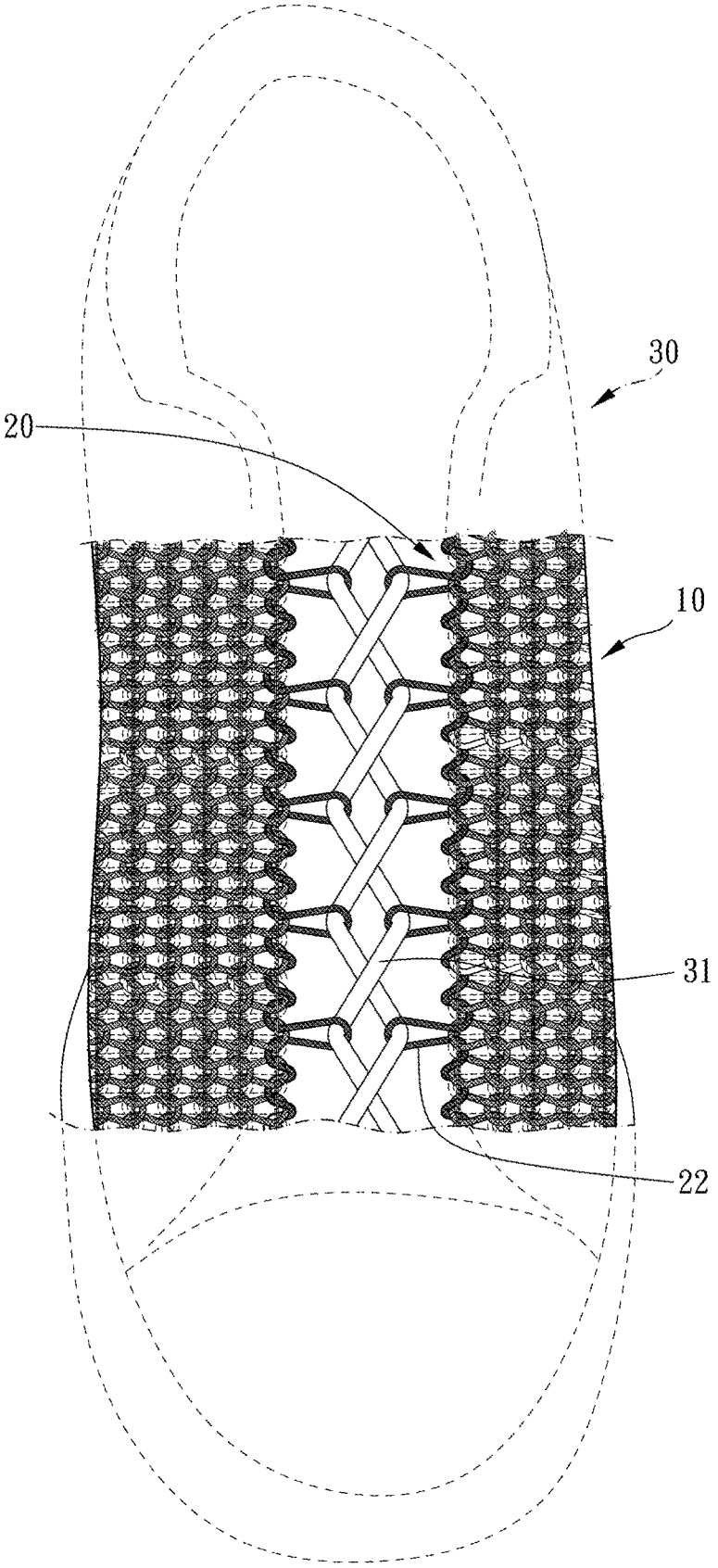
FIG. 3 is an illustration of the present invention.

Please refer to FIG. 1 to FIG. 3, the woven textile of the present invention includes a woven body 10 and an engaging portion 20. The woven body 10 is woven by at least one thread and has a plurality through holes. The engaging portion 20 comprises at least one filament 21. The at least one filament 21 is woven with the at least one thread and extends with the at least one thread. The at least one filament 21 extends away from the woven body 10 for a distance and extends reversely back to the woven body 10 to form a loop 22 outside at least one fringe of the woven body 10. The at least one filament 21 forms a plurality of the loops 22 at intervals. Preferably, the at least one filament 21 extends outward from one face of the woven body 10 and further extends reversely to an other face of the woven body 10 to form one of the loops 22.

In the present embodiment, the at least one thread includes at least one first woven thread 11 and at least one binding thread 12. The at least one first woven thread 11 extends in a meandering way. The at least one binding thread 12 is knotted with the at least one first woven thread 11 to fix the at least one first woven thread 11 to form the through holes. Specifically, a plurality of the first woven threads 11 are included. The first woven threads 11 are parallel aligned to be a plurality of rows. The first woven threads 11 extend in a same meandering way. Adjacent first woven threads 11 overlap partially. The at least binding thread 12 is knotted to an overlap portion of two adjacent first woven threads 11.

More specifically, the at least one thread further includes a plurality of second woven threads 13. The second woven threads 13 are parallel aligned to be a plurality of rows. The second woven threads 13 extend in a same meandering way and have a plurality of crests 131 and troughs 132 respectively. Each of the crests 131 of each of the second woven threads 13 is located between two adjacent troughs 132 of an adjacent second woven thread 13 and is adjacent to the two troughs 132. The first woven threads 11 and the second woven threads 13 are stacked together so that the overlap portions of the first woven threads 11 correspond to the crests 131 and the troughs 132 of the second woven threads 13. The at least one binding thread 12 is knotted with the overlap portions of the first woven threads 11 and the crests 131 and the troughs 132 of the second woven threads 13 to fix the first woven threads 11 and the second woven threads 13 together. In addition, an extending direction of the at least one binding thread 12 is the same with both an extending direction of the first woven threads 11 and an extending direction of the second woven threads 13. Besides, more preferably, the at least one filament 21 is woven with one of the first woven thread 11 at a fringe of the woven body 10.

In the present embodiment, the engaging portion 20 includes two said filaments 21 woven with the at least one thread at two sides of the woven body 10 to form a plurality of loops 22 respectively. Thereby, when the woven body 10 is bent and curled, the loops 22 formed by the two filaments 21 correspond to each other for engagement.

In use, as shown in FIG. 3, the woven textile can be used on the surface of shoe body 30 or other object. When the engaging portion 20 is located beside the shoe tongue, the paired loops 22 can be used for shoelace 31 to insert through.

In conclusion, the loops of the woven textile of the present invention are formed by other filament instead of formed directly from the mesh of the woven body. Thus, when the loops are pulled by the shoelace, the woven body may not deform partially. In addition, the shape, the size, the interval, and the material of the loops can be alternated and different from the woven body, and the process of manufacture is simpler. Besides, any finished product can be further processed to add the engaging portion.

What is claimed is:

1. A woven textile, including a woven body and an engaging portion, the woven body being woven by at least one thread and having a plurality through holes, the engaging portion comprising at least one filament, the at least one filament being woven with the at least one thread and extending with the at least one thread, the at least one filament extending away from the woven body for a distance and extending reversely back to the woven body to form a loop outside at least one fringe of the woven body, the at least one filament forming a plurality of the loops at intervals;

wherein the at least one thread includes at least one first woven thread and at least one binding thread, the at least one first woven thread extends in a meandering way, the at least one binding thread is knotted with the at least one first woven thread to fix the at least one first woven thread to form the through holes;

wherein the woven textile include a plurality of the first woven threads, the first woven threads are parallel aligned to be a plurality of rows, the first woven threads extend in a same meandering way, adjacent first woven threads overlap partially, the at least binding thread is knotted to an overlap portion of two adjacent first woven threads;

wherein the at least one thread further includes a plurality of second woven threads, the second woven threads are parallel aligned to be a plurality of rows, the second woven threads extend in a same meandering way and have a plurality of crests and troughs respectively, each of the crests of each of the second woven threads is located between two adjacent troughs of an adjacent second woven thread and is adjacent to the two troughs, the first woven threads and the second woven threads are stacked together so that the overlap portions of the first woven threads correspond to the crests and the troughs of the second woven threads, the at least one binding thread is knotted with the overlap portions of the first woven threads and the crests and the troughs of the second woven threads to fix the first woven threads and the second woven threads together.

2. The woven textile of claim 1, wherein an extending direction of the at least one binding thread is the same with both an extending direction of the first woven threads and an extending direction of the second woven threads.

3. The woven textile of claim 1, wherein the at least one filament is woven with the at least one first woven thread at a fringe of the woven body.

4. The woven textile of claim 1, wherein the at least one filament is woven with one of the first woven thread at a fringe of the woven body.

5. The woven textile of claim 1, wherein the engaging portion includes two said filaments, the two filaments are woven with the at least one thread at two sides of the woven body to form a plurality of loops respectively.

6. The woven textile of claim 1, wherein the at least one filament extends outward from one face of the woven body and further extends reversely to an other face of the woven body to form one of the loops.

* * * * *